United States Patent [19]

Watanabe

[11] Patent Number: 4,708,671

[45] Date of Patent: Nov. 24, 1987

[54] WATERCRAFT WITH THRUST-REVERSING DEVICE

[75] Inventor: Katumi Watanabe, Akashi, Japan

[73] Assignee: Kawasaki Jukogyo Kabushiki Kaisha, Kobe, Japan

[21] Appl. No.: 867,531

[22] Filed: May 28, 1986

[30] Foreign Application Priority Data

May 31, 1985 [JP] Japan ..... 60-83101[U]

[51] Int. Cl.[4] ..... B63H 11/11

[52] U.S. Cl. ..... 440/41; 60/222; 114/270

[58] Field of Search ..... 60/221, 222; 114/151, 114/270; 440/38, 40–43, 67–69

[56] References Cited

U.S. PATENT DOCUMENTS

| | | | |
|---|---|---|---|
| 600,483 | 3/1898 | Nowak | 440/69 X |
| 3,934,538 | 1/1976 | Canazzi | 440/43 |
| 4,085,694 | 4/1978 | Schilling et al. | 440/67 |

FOREIGN PATENT DOCUMENTS

| | | | |
|---|---|---|---|
| 75297 | 6/1981 | Japan | 440/41 |

*Primary Examiner*—Sherman D. Basinger

*Attorney, Agent, or Firm*—Marshall, O'Toole, Gerstein, Murray & Bicknell

[57] ABSTRACT

This disclosure relates to a small craft equipped with a water jet propulsion system and a thrust-reversing device. The thrust-reversing device is supported for movement up and down between an operating position located directly to the rear of the exhaust port of the jet propulsion system and a retracted position located upwardly from the operating position. The thrust-reversing device includes a U-shaped water guide passage which extends laterally; the left and right ends of the water guide passage are shaped into concave ends which curve forwardly; and the bottom of the hull of the craft includes channels aligned with the curved ends of the water guide passage of the thrust-reversing device when the device is at the operating position.

4 Claims, 6 Drawing Figures

WATERCRAFT WITH THRUST-REVERSING DEVICE

This invention relates to small water craft of the type used primarily for leisure recreational activities, wherein the craft is propelled by a water-jet propulsion system.

Small crafts equipped with jet propulsion systems are already in wide use, and because the bottom of the hull of such crafts normally have no projecting parts, they have the advantage of being capable of operating in extremely shallow water without hindrance, especially in comparison to crafts equipped with conventional propeller propulsion devices. In addition, crafts equipped with jet propulsion systems which are also equipped with thrust-reversing devices have also been introduced. For example, see Japanese Utility Model Pub. No. 56-39757, published Sept. 16, 1981, which shows a thrust reversing device. However, when using the thrust-reversing device of this publication, there exists the problem that, during operation of the thrust-reversing device, part of the thrust-reversing device projects from the bottom of the hull, thus cancelling out the aforementioned advantage of an absence of downwardly projecting parts. U.S. Pat. No. 4,004,541 dated Jan. 25, 1977 shows a jet propelled boat including a thrust reversal means including a generally U-shaped control gate 218 (FIGS. 8 and 10) and a part 308 (FIG. 14) which can be rotated upwardly out of the way of the water jet as shown, for example, in FIG. 7.

SUMMARY OF THE INVENTION

A small craft in accordance with this invention comprises a hull, a jet propulsion system, and a thrust-reversing device. The propulsion system includes an exhaust port from which a water jet emerges during operation. The thrust-reversing device is supported on the hull movably up and down between an operating position where it is located directly to the rear of the exhaust port and a retracted position located upwardly from the port and the operating position. The thrust-reversing device forms a U-shaped water guide passage extending laterally of the hull, the left and right ends of the water guide passage being shaped into concave ends which curve forwardly. The hull includes channels which are aligned with the curved ends of the water guide passage of the thrust-reversing device and conduct the water forwardly during operation of the thrust-reversing device.

BRIEF DESCRIPTION OF THE DRAWINGS

This invention will be better understood from the following detailed description taken in conjunction with the accompanying figures of the drawings wherein.

DETAILED DESCRIPTION

Figure 1:
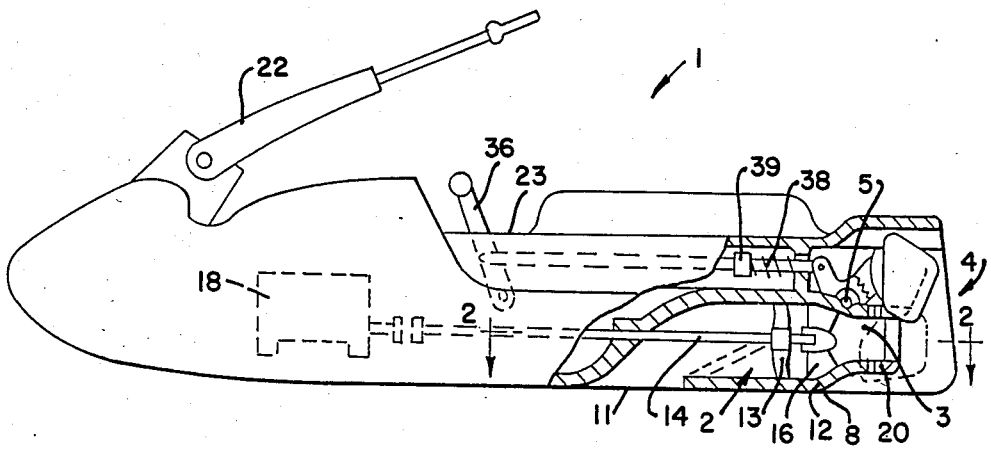
FIG. 1 is a side view partially in cross section of a craft including a jet propulsion system and thrust-reversing device in accordance with the invention.

A small water craft 1 in accordance with this invention is equipped with a water jet propulsion system 2 and a thrust-reversing device 4. The thrust-reversing device 4 is supported for swinging up and down movement by, for example, a shaft 5, between an operating position (indicated by the dash-dot line in FIG. 1) located directly to the rear of the exhaust port 3 of the jet propulsion device 2, and a retracted position (indicated by the solid line in FIG. 1) located upwardly from the operating position. The thrust-reversing device 4 includes a wall 6 which is U-shaped in cross section (see FIG. 3). The opening of the U faces forwardly when the device 4 is in the operating position and it faces downwardly when it is in the retracted position. When in the operating position, the wall 6 extends across the rearward end of the port 3 and its ends curve forwardly to form a U-shaped water guide passage 7 which extends laterally to both sides and then forwardly. As shown in FIG. 2, the ends of the wall 6 have a concave shape and curve forwardly. In addition, the bottom 8 of the hull of the craft includes water channels 9 aligned with the opposite ends of the water guide passage 7 of the thrust-reversing device 4 when it is at the aforementioned operating position.

During operation of the craft, the thrust-reversing device 4 is normally retracted upwardly, but during deceleration, it is swung downwardly to the operating position. When the thrust-reversing device 4 is swung downwardly, the water jet from the port 3 is directed sideways and then forwardly through the water guide passage 7 and into the channels 9 in the bottom 8 of the hull, without the thrust-reversing device 4 extending below the bottom 8 of the hull.

In addition the bottom 8 of the hull includes a water intake port 11 (FIGS. 1 and 3) which slants upwardly and rearwardly. A tubular casing 12 connects this intake port 11 with the exhaust port 3.

The jet propulsion system 2 includes this casing 12, an impeller 13 which is rotatably supported by a shaft 14 inside the casing 12 and guide vanes 16 which is located at the rear of the impeller 13 and which has a bearing 17 that supports the shaft 14.

Figure 2:
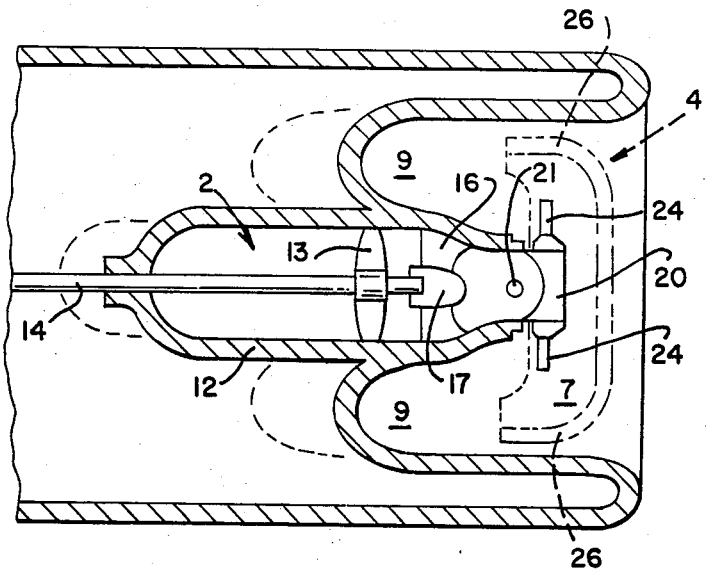
FIG. 2 is an enlarged sectional view taken on the line 2—2 of FIG. 1.

The aforementioned shaft 14 passes through the easing 12 and extends toward the front of the craft, and is connected to the power output shaft of an engine 18 (FIG. 1).

A nozzle 20 is supported for swinging movement left and right at the rear of the aforementioned exhaust port 3. This nozzle 20 swings left and right on a vertical axis formed by pins 21. A control handle 22 (FIG. 1) is provided at an operator's platform 23, and the handle 22 is connected by linkages (not shown) to pins 24 at the sides of the nozzle to swing the nozzle on the pins 21, thus steering the craft left and right.

Figure 3:
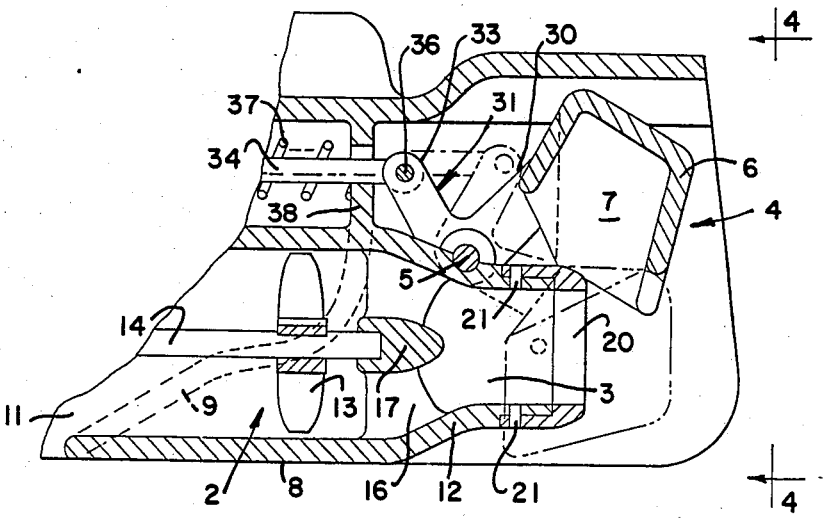
FIG. 3 is a fragmentary enlarged view of a portion of the structure shown in FIG. 1.
Figure 4:
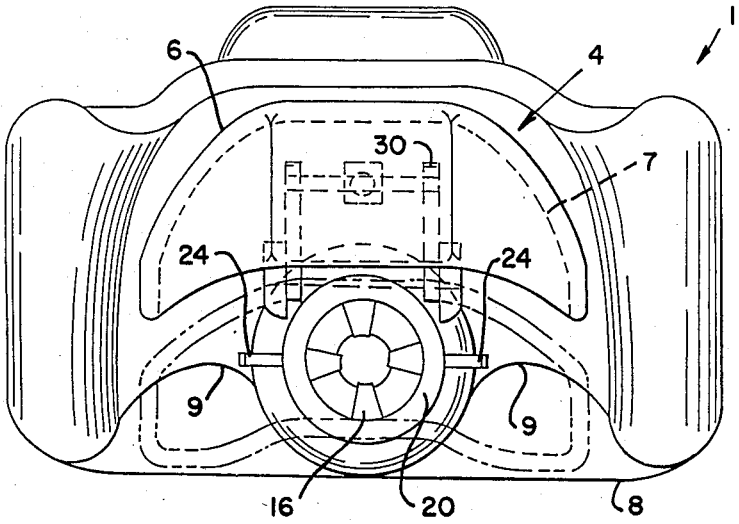
FIG. 4 is a view taken on the line 4—4 of FIG. 3.

The channels 9 and are provided on the left and right sides of the nozzle 20 in alignment with the left and right concave ends 26 of the thrust-reversing device 4, and the channels are shaped so that the front parts slant downward and forwardly (see FIG. 3). In consideration of the stability of the craft during deceleration, the optimum angle for the slant of the channels 9 relative to the bottom 8 of the hull is approximately 45°.

To control the thrust-reversing device 4, one arm 30 of a bell crank 31 is secured to the upper-front part of the thrust-reversing device 4, and this bell crank 31 is pivotably supported on the casing 12 by the shaft 5. The bell crank 31 swings the thrust-reversing device 4 vertically, in other words, it raises and lowers it as the bell crank is pivoted.

The other arm 33 of the bell crank 31 is connected to an operating rod 34 by a pivot pin 36. This operating rod 34 extends toward the front of the craft and is connected to an operating lever 36 (FIG. 1) mounted adjacent operator's platform 23. A compression spring 37 is provided between the aforementioned operating rod 34 and a bulkhead 38 of the craft, and this compression spring 38 engages a collar 39 and constantly urges the operating rod 34 toward the front of the craft. Thus, the thrust-reversing device 4 is normally held in the retracted position, and it is swung downwardly to the operating position only through the movement of the operating lever 36 (FIG. 1).

When the jet propulsion system 2 is operated while the thrust-reversing device 4 is raised to the retracted position indicated by the solid lines in FIGS. 1 and 3, the craft is propelled forwardly by the reaction to the jet of water flowing from the exhaust port nozzle 20.

However, when the thrust-reversing device 4 is lowered to the operating position directly to the rear of the nozzle 20, as indicated by the broken lines in FIGS. 1 and 3 in order to slow the forward motion of the craft, the jet of water flowing from the nozzle hits the thrust-reversing device 4 and is divided left and right through the water guide passage 7 which extends laterally. The jet of water is then directed toward the front of the craft by the left and right concave ends of the water guide passage 7 and is finally sprayed through the channels 9 in the bottom of the hull. This forward and downward spraying of the water jet causes a backward-directed force to be exerted on the craft, thus resulting in deceleration of the forward motion.

Figure 5:
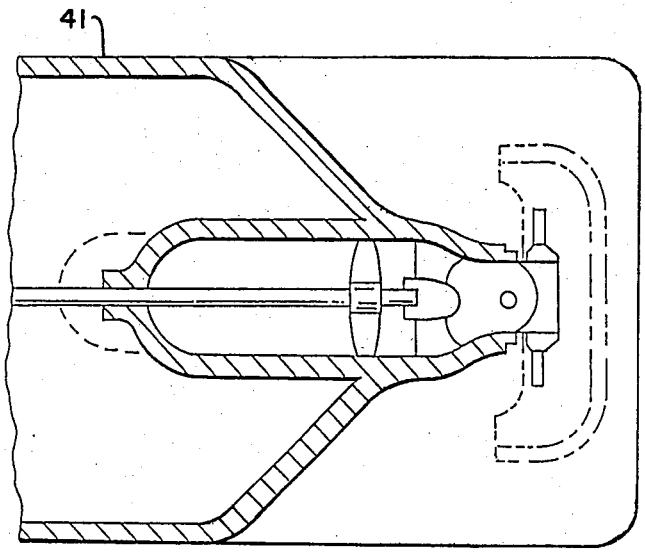
FIG. 5 is a view similar to FIG. 2 but showing an alternative embodiment of the invention.
Figure 6:
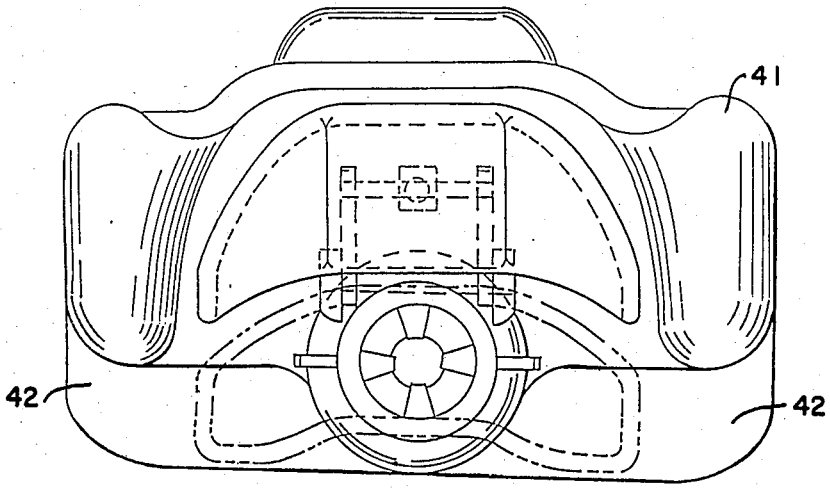
FIG. 6 is a view similar to FIG. 4 of the alternative embodiment.

In the arrangement shown in FIGS. 1–4, the channels 9 are formed in the bottom of the hull. FIGS. 5 and 6 show an alternative arrangement wherein the channels are formed on laterally opposite sides of the nozzle. The jet propulsion system and the thrust-reversing device may be constructed substantially as shown in FIGS. 1–4. The hull 41 of the craft includes channels 42 formed on laterally opposite sides of the nozzle. Therefore, when the thrust-reversing device is in the operating position, the water jet is directed laterally of the nozzle and then forwardly through the channels 42 toward the sides of the hull. As in the first described embodiment, the reversely directed jets of water act to decelerate the craft. Since the jets extend essentially forwardly and laterally from opposite sides of the hull, the reversely directed jets do not destabilize the craft.

Instead of the mechanisms described in detail herein, modifications may be made within the scope of the invention. For example, link mechanisms, hydraulic mechanisms, and other known devices may be used as the means for supporting and moving the thrust-reversing device in such a manner as to raise and lower it.

It will be apparent from the foregoing that a novel and useful invention has been provided. The jet is reversed by the operation of the thrust-reversing device and flows into two channels formed in the hull of the craft. During operation of the thrust-reversing device, the device neither descends below the bottom of the boat nor protrudes in any way from the bottom of the boat, thus making the invention extremely effective in enabling the craft to operate in shallow water during both forward jet thrust and reverse jet thrust. Further, the channels in the hull and the device 4 form symmetrical reverse thrust jets which do not destablize the craft.

What is claimed is:

1. A small water craft comprising a hull, a propulsion system on said hull including a nozzle and means for ejecting a jet of water out of said nozzle, a thrust-reversing device pivotably mounted on said hull adjacent said nozzle and movable between an operating position and a retracted position, said device forming a generally U-shaped passage extending substantially laterally of said hull and said passage having concave ends which curve laterally and forwardly, said device when in said operating position being positioned in the path of said jet and directing said jet laterally and forwardly in said passage way, said hull having channels therein generally aligned with said concave ends and conducting said jet generally forwardly when said device is in said operating position, said device when in said retracted position being displaced upwardly out of the path of said jet, said device when in said operating position being no lower than said hull, said hull having a longitudinal centerline, said nozzle and said device being substantially on said centerline, and said channels being symmetrically positioned on opposite sides of said centerline.

2. A craft as set forth in claim 1, wherein said channels extend laterally and forwardly from said device.

3. A craft as set forth in claim 1, wherein said channels extend downwardly and forwardly from said device.

4. A craft as set forth in claim 3, wherein said hull has a bottom wall, and said channels make an angle of approximately 45° relative to said bottom wall.

* * * * *